US007785756B2

(12) United States Patent
Yanus et al.

(10) Patent No.: US 7,785,756 B2
(45) **Date of Patent: *Aug. 31, 2010**

(54) OVERCOATED PHOTOCONDUCTORS WITH THIOPHOSPHATE CONTAINING CHARGE TRANSPORT LAYERS

(75) Inventors: John F. Yanus, Webster, NY (US); Jin Wu, Webster, NY (US); Kenny-Tuan Dinh, Webster, NY (US); Michael A. Morgan, Fairport, NY (US); Anthony M. Horgan, Pittsford, NY (US); Kathleen M. Carmichael, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 967 days.

This patent is subject to a terminal disclaimer.

(21) Appl. No.: 11/593,657

(22) Filed: Nov. 7, 2006

(65) Prior Publication Data

US 2008/0107984 A1 May 8, 2008

(51) Int. Cl.
*G03G 15/02* (2006.01)

(52) U.S. Cl. ..... 430/58.75; 430/59.1; 430/66; 430/132

(58) Field of Classification Search ..... 430/58.75, 430/59.1, 66, 132
See application file for complete search history.

(56) References Cited

U.S. PATENT DOCUMENTS

| | | | | |
|---|---|---|---|---|
| 3,121,006 | A | 2/1964 | Middleton et al. | |
| 4,265,990 | A | 5/1981 | Stolka et al. | |
| 4,464,450 | A | 8/1984 | Teuscher | |
| 4,587,189 | A | 5/1986 | Hor et al. | |
| 4,921,769 | A | 5/1990 | Yuh et al. | |
| 4,921,773 | A | 5/1990 | Melnyk et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 5,607,896 | A * | 3/1997 | Hutt | 503/227 |
| 6,913,863 | B2 | 7/2005 | Wu et al. | |
| 7,037,631 | B2 | 5/2006 | Wu et al. | |
| 7,476,477 | B2 * | 1/2009 | Wu et al. | 430/58.8 |
| 7,491,480 | B2 * | 2/2009 | Wu et al. | 430/58.8 |
| 7,572,561 | B2 * | 8/2009 | Dinh et al. | 430/66 |

OTHER PUBLICATIONS

Jin Wu et al., U.S. Appl. No. 11/485,645 on Silanol Containing Photoconductors, filed Jun. 12, 2006.
Jin Wu et al., U.S. Appl. No. 11/485,550 on Silanol Containing Photoconductors, filed Jun. 12, 2006.
Jin Wu et al., U.S. Appl. No. 11/453,392 on Ether Phosphate Containing Photoconductors, filed Jun. 15, 2006.
Jin Wu et al., U.S. Appl. No. 11/453,621 on Ether Phosphate Containing Photoconductors, filed Jun. 15, 2006.
Jin Wu et al., U.S. Appl. No. 11/453,621 on Polyphenyl Ether Containing Photoconductors, filed Jun. 15, 2006.
Jin Wu et al., U.S. Appl. No. 11/453,379 on Polyphenyl Ether Phosphate Containing Photoconductors, filed Jun. 15, 2006.
Jin Wu et al., U.S. Appl. No. 11/453,742 on Polyphenyl Ether Phosphate Containing Photoconductors, filed Jun. 15, 2006.
Jin Wu et al., U.S. Appl. No. 11/453,740 on Polyphenyl Thioether Phosphate Containing Photoconductors, filed Jun. 15, 2006.
Jin Wu et al., U.S. Appl. No. 11/453,607 on Polyphenyl Thioether Phosphate Containing Photoconductors, filed Jun. 15, 2006.
Jin Wu et al., U.S. Appl. No. 11/453,739 on Polyphenyl Thioether Phosphate Containing Photoconductors, filed Jun. 15, 2006.
Jin Wu et al., U.S. Appl. No. 11/453,613 on Thiophosphate Containing Photoconductors, filed Jun. 15, 2006.
Jin Wu et al., U.S. Appl. No. 11/453,743 on Thiophosphate Containing Photoconductors, filed Jun. 15, 2006.
Jin Wu et al., U.S. Appl. No. 11/453,489 on Thiophosphate Containing Photoconductors, filed Jun. 15, 2006.

* cited by examiner

*Primary Examiner*—Thorl Chea
(74) *Attorney, Agent, or Firm*—E. O. Palazzo

(57) ABSTRACT

A photoconductor containing an optional supporting substrate, a containing photogenerating layer, at least one thiophosphate containing charge transport layer, and a top overcoating crosslinked polymer layer in contact with and contiguous to the charge transport layer.

43 Claims, No Drawings

OVERCOATED PHOTOCONDUCTORS WITH THIOPHOSPHATE CONTAINING CHARGE TRANSPORT LAYERS

CROSS REFERENCE TO RELATED APPLICATIONS

The disclosures of each of the following copending applications are totally incorporated herein by reference.

U.S. application Ser. No. 11/593,662, filed Nov. 7, 2006, U.S. Publication No. 20080107983, on Overcoated Photoconductors with Thiophosphate Containing Photogenerating Layer, by John F. Yanus et al.

U.S. application Ser. No. 11/593,875, filed Nov. 7, 2006, U.S. Publication No. 20080107985, on Silanol Containing Overcoated Photoconductors, by John F. Yanus et al.

U.S. application Ser. No. 11/593,656, filed Nov. 7, 2006, U.S. Publication No. 20080107979, on Silanol Containing charge Transport Overcoated Photoconductors, by John F. Yanus et al.

In U.S. application Ser. No. 11/485,645, now U.S. Pat. No. 7,560,206, filed Jun. 12, 2006 by Jin Wu et al., there is illustrated an imaging member comprising an optional supporting substrate, a photogenerating layer containing a silanol, and at least one charge transport layer comprised of at least one charge transport component.

In U.S. application Ser. No. 11/485,550, now U.S. Pat. No. 7,541,122, filed Jun. 12, 2006 by Jin Wu et al., there is illustrated an imaging member comprising an optional supporting substrate, a photogenerating layer, and at least one charge transport layer comprised of at least one charge transport component, and at least one silanol.

U.S. application Ser. No. 11/453,392, now U.S. Pat. No. 7,479,358, filed Jun. 15, 2006 on Ether Phosphate Containing Photoconductors, by Jin Wu et al.

U.S. application Ser. No. 11/453,621, now U.S. Pat. No. 7,445,876, filed Jun. 15, 2006 on Ether Phosphate Containing Photoconductors, by Jin Wu et al.

U.S. application Ser. No. 11/453,622, now U.S. Pat. No. 7,459,250, filed Jun. 15, 2006 on Polyphenyl Ether Containing Photoconductors, by Jin Wu et al.

U.S. application Ser. No. 11/453,379, now U.S. Pat. No. 7,507,510, filed Jun. 15, 2006 on Polyphenyl Ether Phosphate Containing Photoconductors, by Jin Wu et al.

U.S. application Ser. No. 11/453,742, now U.S. Pat. No. 7,452,643, filed Jun. 15, 2006 on Polyphenyl Ether Phosphate Containing Photoconductors, by Jin Wu et al.

U.S. application Ser. No. 11/453,740, now U.S. Pat. No. 7,476,478, filed Jun. 15, 2006 on Polyphenyl Thioether Containing Photoconductors, by Jin Wu et al.

U.S. application Ser. No. 11/453,607, now U.S. Pat. No. 7,462,432, filed Jun. 15, 2006 on Polyphenyl Thioether Phosphate Containing Photoconductors, by Jin Wu et al.

U.S. application Ser. No. 11/453,739, now U.S. Pat. No. 7,468,229, filed Jun. 15, 2006 on Polyphenyl Thioether Phosphate Containing Photoconductors, by Jin Wu et al.

U.S. application Ser. No. 11/453,613, now U.S. Pat. No. 7,476,477, filed Jun. 15, 2006 on Thiophosphate Containing Photoconductors, by Jin Wu et al.

U.S. application Ser. No. 11/453,743, now U.S. Pat. No. 7,498,108, filed Jun. 15, 2006 on Thiophosphate Containing Photoconductors, by Jin Wu et al.

U.S. application Ser. No. 11/453,489, now U.S. Pat. No. 7,491,480, filed Jun. 15, 2006 on Thiophosphate Containing Photoconductors, by Jin Wu et al.

A number of the components and amounts thereof of the above copending applications, such as the supporting substrates, resin binders, photogenerating layer components, antioxidants, charge transport components, silanols, dialkyldithiophosphates, hole blocking layer components, adhesive layers, and the like, may be selected for the members of the present disclosure in embodiments thereof.

BACKGROUND

This disclosure is generally directed to layered imaging members, photoreceptors, photoconductors, and the like. More specifically, the present disclosure is directed to multilayered flexible, belt imaging members, or devices comprised of an optional supporting medium like a substrate, a thiophosphate containing photogenerating layer, or a thiophosphate, such as a zinc dialkyldithiophosphate (ZDDP), containing charge transport layer, including a plurality of charge transport layers, such as a first charge transport layer and a second charge transport layer, an optional adhesive layer, an optional hole blocking or undercoat layer, and an overcoating layer, and optionally wherein at least one of the charge transport layers contains at least one charge transport component, a polymer or resin binder, a dialkyldithiophosphate, and an optional antioxidant. Moreover, at least one of the charge transport layers can be free of a dialkyldithiophosphate; and in embodiments, the photogenerating layer contains a dialkyldithiophosphate, and the charge transport layers are free of a dialkyldithiophosphate; and in embodiments, the charge transport layer contains a dialkylthiophosphate, and the photogenerating layer is free, that is this layer does not contain a dialkyldithiophosphate.

The photoreceptors illustrated herein, in embodiments, have excellent wear resistance, extended lifetimes, elimination or minimization of imaging member scratches, and which scratches can result in undesirable print failures where, for example, the scratches are visible on the final prints generated. Additionally, in embodiments the imaging members disclosed herein possess excellent, and in a number of instances low $V_r$ (residual potential), and allow the substantial prevention of $V_r$ cycle up when appropriate; high sensitivity; low acceptable image ghosting characteristics; low background and/or minimal charge deficient spots (CDS); and desirable toner cleanability. More specifically, there is illustrated herein in embodiments the incorporation of suitable dialkyldithiophosphates in an imaging member, which dialkyldithiophosphates can be included in at least one charge transport layer, the photogenerating layer, or in both the at least one charge transport layer and the photogenerating layer. At least one in embodiments refers, for example, to one, to from 1 to about 10, to from 2 to about 7; to from 2 to about 4, to 2, and the like. Moreover, the dialkyldithiophosphates, which in embodiments are transparent and substantially soluble in the charge transport layers solution, can be added to the at least one of the charge transport layers, that is for example, instead of being dissolved in the charge transport layer solution, the dialkyldithiophosphates can be added to the charge transport as a dopant, and more specifically, the dialkyldithiophosphates can be added to the top charge transport layer. Similarly, the dialkyldithiophosphates can be included in the photogenerating layer dispersion prior to the deposition of this layer on the substrate.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, and processes of the above recited patents may be selected for the present disclosure in embodiments thereof.

SUMMARY

Disclosed are imaging members with many of the advantages illustrated herein, such as extended lifetimes of service of, for example, in excess of about 3,500,000 imaging cycles; excellent electronic characteristics; stable electrical properties; low image ghosting; low background and/or minimal charge deficient spots (CDS); resistance to charge transport layer cracking upon exposure to the vapor of certain solvents; excellent surface characteristics; improved wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDCs (Photo-Induced Discharge Curve); minimum cycle up in residual potential; acceptable background voltage that is, for example, a minimum background voltage of about 2.6 milliseconds after exposure of the photoconductor to a light source; rapid PIDCs together with low residual voltages, and the like.

Also disclosed are layered photoresponsive imaging members which are responsive to near infrared radiation of from about 700 to about 900 nanometers.

Further disclosed are layered flexible photoresponsive imaging members with sensitivity to visible light.

Moreover, disclosed are layered belt photoresponsive or photoconductive imaging members with mechanically robust and solvent resistant charge transport layers.

Additionally disclosed are flexible imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$.

Also disclosed are layered flexible belt photoreceptors wherein there is permitted the prevention of $V_r$ cycle up, caused primarily by photoconductor aging, for numerous imaging cycles, and layered flexible belt photoreceptors, and where the resulting imaging members exhibit low background and/or minimal CDS; and the prevention of $V_r$ cycle up, caused primarily by photoconductor aging, for numerous imaging cycles.

EMBODIMENTS

Aspects of the present disclosure relate to a flexible photoconductor comprised in sequence of a substrate, a photogenerating layer, and at least one charge transport layer comprised of at least one charge transport component, and wherein the at least one charge transport layer is comprised of hole transport molecules and at least one dialkyldithiophosphate

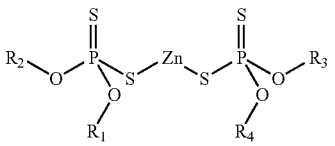

-continued

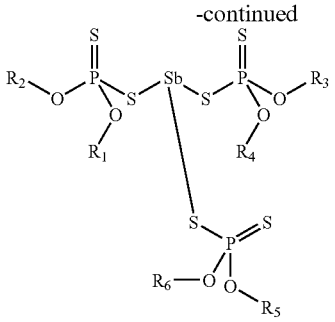

wherein $R_1$, $R_2$, $R_3$, $R_4$, $R_5$ and $R_6$ each independently represents at least one of a hydrogen atom, and a suitable hydrocarbon; and an overcoating layer in contact with and contiguous to the top charge transport layer, and which overcoating layer is formed by the reaction of an acrylate polyol, a polyalkylene, a crosslinking agent, and a charge transport compound in the presence of a catalyst resulting in a polymeric network primarily containing the acrylate polyol, the glycol, and charge transport compound; an imaging wherein the overcoating charge transport component is

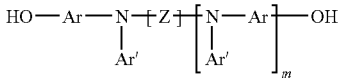

wherein m is zero or 1; Z is selected from the group consisting of at least one of

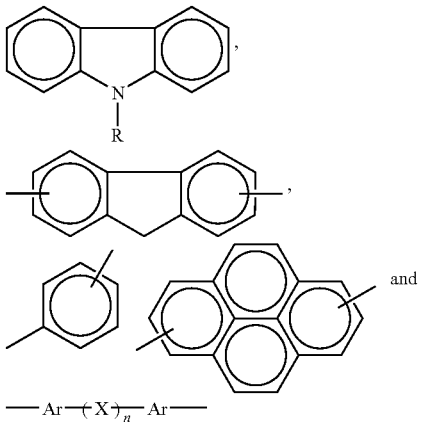

wherein n is 0 or 1; Ar is selected from the group consisting of at least one of

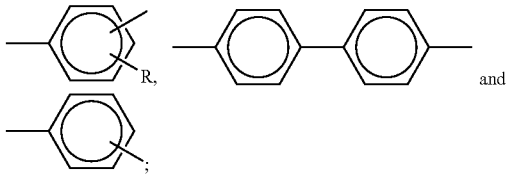

R is selected from the group consisting of at least one of —$CH_3$, —$C_2H_5$, —$C_3H_7$, and $C_4H_9$, and Ar' is selected from the group consisting of at least one of

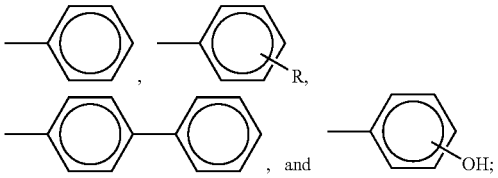

and X is selected from the group consisting of at least one of

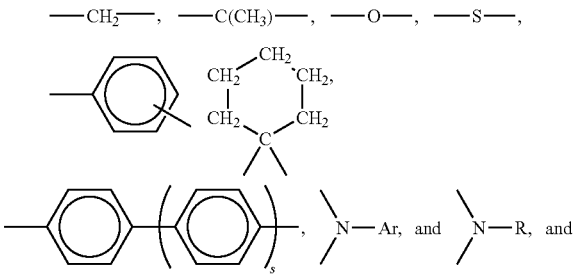

wherein S is zero, 1, or 2; a photoconductor comprising a substrate, a photogenerating layer, and at least one charge transport layer comprised of at least one charge transport component, and wherein the at least one charge transport layer is comprised of hole transport molecules and a thiophosphate represented by formulas/structures

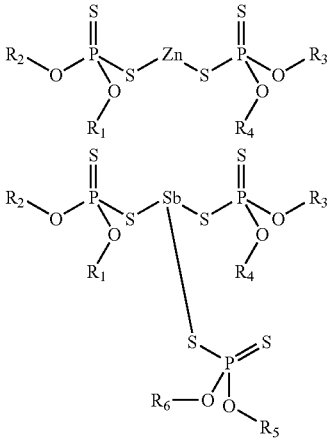

wherein $R_1$, $R_2$, $R_3$, $R_4$, $R_5$ and $R_6$ each independently represents a hydrogen atom; alkyl, alkoxy, or aryl, and wherein at least one charge transport layer is comprised of from 2 to about 4 layers, and wherein 1 layer, 2 layers, 3 layers, or 4 charge transport layers contain a thiophosphate; and a layer in contact with and contiguous to the top charge transport layer, and which layer is formed by the reaction of an acrylate polyol, a polyalkylene glycol, a crosslinking agent, and a charge transport compound in the presence of a catalyst resulting in a polymeric network. More specifically, at least one of $R_1$, $R_2$, $R_3$, $R_4$, $R_5$ and $R_6$ represents a hydrogen atom; an alkyl group with, for example, from 1 to about 20 carbon atoms; a cycloalkyl group with, for example, from 6 to about 26 carbon atoms; hydrocarbyl with, for example, from about 3 to about 20 carbon atoms containing an ester, an ether, an alcohol or a carboxyl group; a straight chain or branched alkyl with, for example, from 2 to about 18 carbon atoms; and the like.

In embodiments, for the thiophosphates at least one of $R_1$, $R_2$, $R_3$, $R_4$, $R_5$ and $R_6$ represents a hydrogen atom; alkyl with, for example, from 1 to about 12 carbon atoms; cycloalkyl with, for example, from about 6 to about 20 carbon atoms; aryl, alkylaryl or arylalkyl groups with from about 6 to about 50 carbon atoms; a hydrocarbyl group containing, for example, from about 5 to about 15 carbon atoms, and containing an ester, ether, alcohol or carboxyl group; and an alkyl group which may be straight, chain or branched with, for example, from about 2 to about 15 carbon atoms, or from about 3 to about 8 carbon atoms. Examples of alkyl and alkoxy groups include methyl, ethyl, propyl, isopropyl, butyl, isobutyl, pentyl, hexyl ethylhexyl, derivatives thereof, and the like, and mixtures thereof, and the corresponding alkoxides. Aryl examples are phenyl, naphthyl; aryl substituted with, for example, alkyl and alkoxy, and derivatives thereof. Examples of hydrocarbyl group containing, for example, from about 5 to about 15 carbon atoms, and containing an ester, ether, alcohol or carboxyl group.

Specific examples of metal dialkyldithiophosphates include molybdenum di(2-ethylhexyl)dithiophosphate, zinc diethyldithiophosphate, antimony diamyldithiophosphate, and the like. Commercial zinc dialkyldithiophosphates include ELCO™ 102, 103, 108, 114, 11, and 121, available from Elco Corporation, Cleveland, Ohio. A number of the thiophosphates contain a certain amount of petroleum distillates, mineral oils such as ValPar500™, available from Valero Energy Corporation, San Antonio, Tex. Commercial molybdenum dialkyldithiophosphates include MOLYVAN L™ (molybdenum di(2-ethylhexyl)phosphorodithioate), available from R.T. Vanderbilt Company, Inc., Norwalk, Conn. Commercial antimony dialkyldithiophosphates include VANLUBE™ 622 and 648 (antimony dialkylphosphorodithioate), available from R.T. Vanderbilt Company, Inc., Norwalk, Conn.

Various effective amounts of the thiophosphates, which in embodiments function primarily as permitting excellent photoconductor electricals, although in theory there could be interactions between the thiophosphates and other components present, can be added to each charge transport layer and/or to the photogenerating layer components, such as from about 0.01 to about 30 weight percent, from about 0.1 to about 10 weight percent, or from about 0.5 to about 5 weight percent in the charge transport layer or layers; and from about 0.1 to about 40 weight percent, from about 1 to about 20 weight percent, or from about 5 to about 15 weight percent in the photogenerating layer.

Also disclosed are imaging members comprising an optional supporting substrate, a photogenerating layer containing a silanol, and at least one charge transport layer comprised of at least one charge transport component and an overcoating layer; a photoconductor comprising a supporting substrate, a photogenerating layer comprised of a photogenerating component and a silanol, and at least one charge transport layer comprised of at least one charge transport component, and wherein the silanol is selected from the group comprised of at least one of

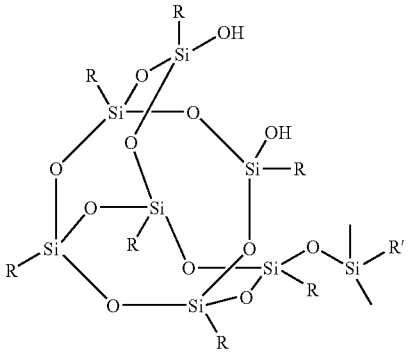

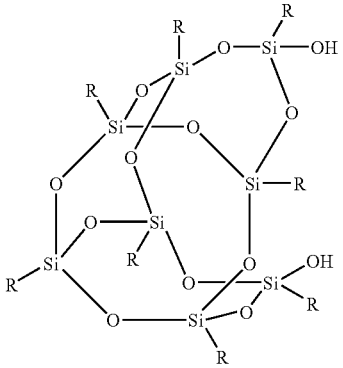

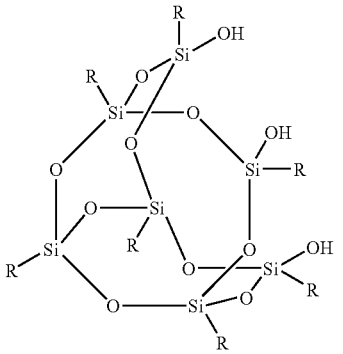

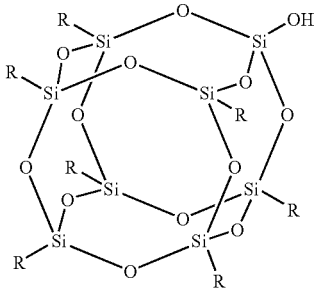

and wherein R and R' are independently a suitable hydrocarbon like alkyl, alkoxy, aryl, and substituted derivatives thereof, and mixtures thereof, and a crosslinked overcoating in contact with and contiguous to the charge transport, and which overcoating is comprised of a charge transport compound, a polymer, and a crosslinking component; a photoconductor comprised in sequence of a supporting substrate, a photogenerating layer comprised of at least one photogenerating pigment, and a silanol; thereover a charge transport layer comprised of at least one charge transport component, and wherein the silanol is selected from the group comprised of at least one of the following; and a layer in contact with and contiguous to the top charge transport layer, and which layer is comprised of a crosslinked polymer which can be formed by the reaction of an acrylate polyol, a polyalkylene glycol, a crosslinking agent, and a charge transport compound in the presence of a catalyst resulting in a polymeric network primarily containing the acrylate polyol, the glycol, the crosslinking agent, and the charge transport compound wherein the silanol is

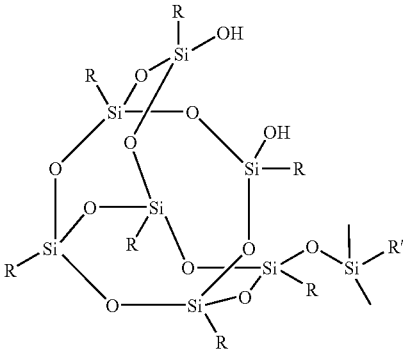

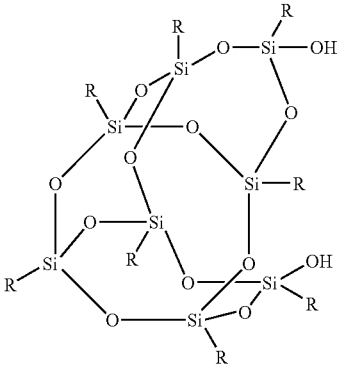

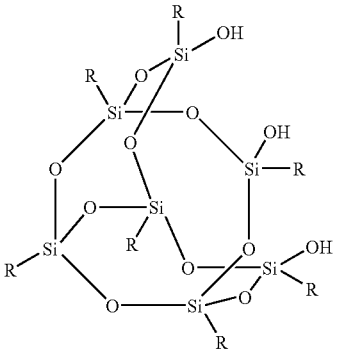

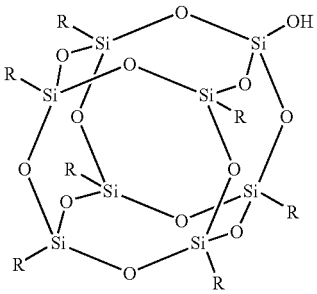

wherein R and R' are independently a suitable hydrocarbon, and wherein the silanol is present in an amount of from about 0.1 to about 40 weight percent; a photoconductor wherein the acrylated polyol is represented by $$(—CH_2—R_a—CH_2)_m—(—CO—R_b—CO—)_n—(—CH_2—R_c—CH_2)_p—(—CO—R_d—CO—)_q$$

where $R_a$ and $R_c$ independently represent at least one of a linear alkyl group, a linear alkoxy group, a branched alkyl group, and a branched alkoxy group wherein each alkyl and alkoxy group contain from about 1 to about 20 carbon atoms; $R_b$ and $R_d$ independently represent at least one of an alkyl and alkoxy wherein the alkyl and the alkoxy each contain from about 1 to about 20 carbon atoms; and m, n, p, and q represent mole fractions of from 0 to 1, such that n+m+p+q=1; a photoconductor comprising an optional substrate, a photogenerating layer comprised of a photogenerating component and a silanol, and at least one charge transport layer comprised of at least one charge transport component, and wherein the photogenerating silanol is selected from the group comprised of the following formulas/structures

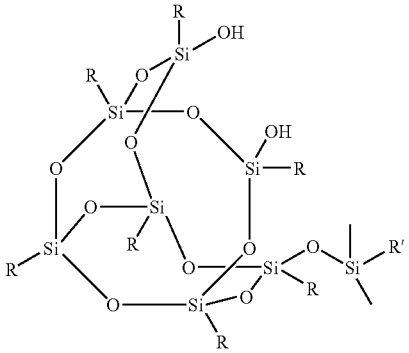

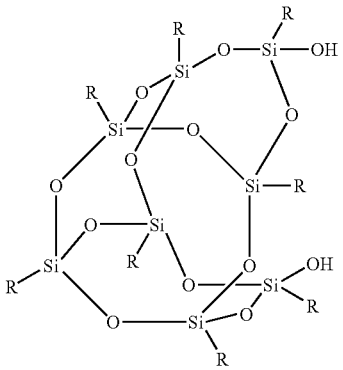

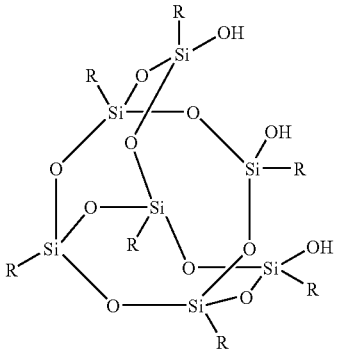

-continued

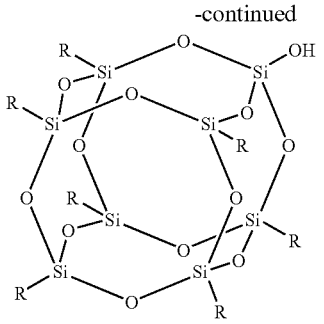

and wherein R and R' are independently alkyl, alkoxy, aryl, and substituted derivatives thereof, and mixtures thereof, and in contact with the charge transport layer a top overcoating layer of POC (protective overcoat); a photoconductor comprised in sequence of a supporting substrate, a photogenerating layer comprised of at least one photogenerating pigment, and a silanol, and thereover at least one charge transport layer comprised of at least one charge transport component, and wherein the silanol is selected from the group comprised of the following formulas/structures

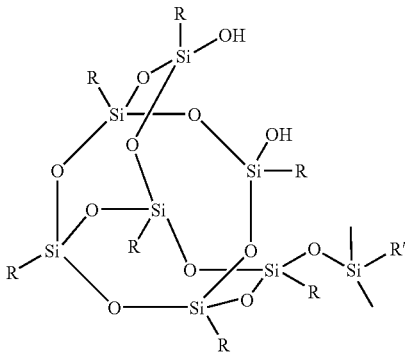

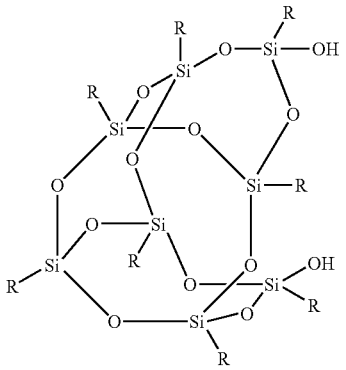

-continued

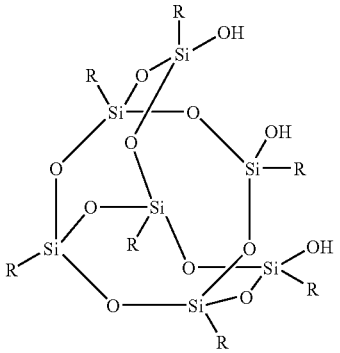

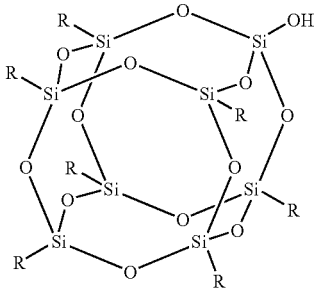

wherein R and R' are independently a suitable hydrocarbon, and wherein the silanol is present in an amount of from about 0.1 to about 40 weight percent, and in contact with the charge transport layer a top overcoating layer or TOC, and which overcoating contains primarily an acrylated polyol, a polyalkylene glycol, wherein alkylene contains, for example, from 1 to about 10 carbon atoms, and more specifically, from 1 to about 4 carbon atoms, a charge transport, such as a hole transport compound, and minor amounts of a catalyst and a crosslinking agent; a flexible imaging member comprising a supporting substrate, a photogenerating layer, and at least two charge transport layers, at least one photogenerating or charge transport containing a silanol of the formulas, which silanols can also be referred to as polyhedral oligomeric silsesquioxane (POSS) silanols

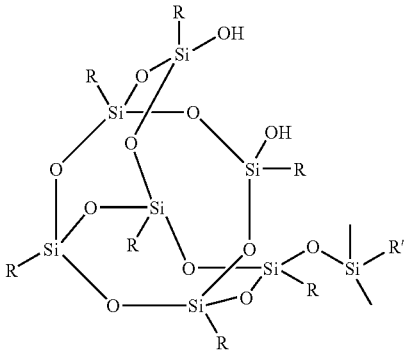

-continued

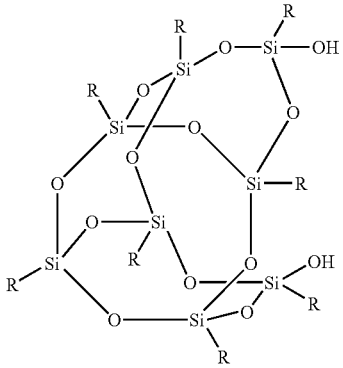

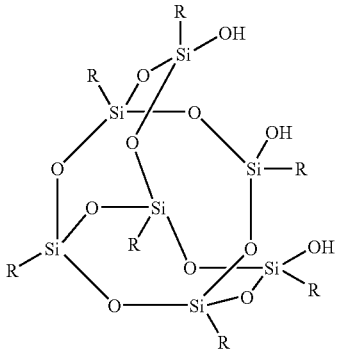

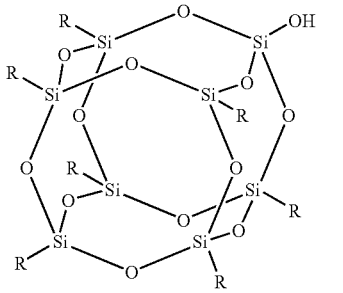

wherein R and R' are independently selected from the group comprised of a suitable hydrocarbon, such as alkyl, alkoxy, aryl, and substituted derivatives thereof, and mixtures thereof with, for example, from 1 to about 36 carbon atoms like phenyl, methyl, vinyl, allyl, isobutyl, isooctyl, cyclopentyl, cyclohexyl, cyclohexenyl-3-ethyl, epoxycyclohexyl-4-ethyl, fluorinated alkyl such as $CF_3CH_2CH_2$— and $CF3(CF_2)_5CH_2CH_2$—, methacrylolpropyl, norbornenylethyl, and the like; and also wherein the R groups includes phenyl, isobutyl, isooctyl, cyclopentyl, cyclohexyl and the like; desired R' group includes methyl, vinyl, fluorinated alkyl, and the like, and in contact with the charge transport layer a top overcoating crosslinked layer comprised of a mixture of polyols, such as a mixture of an acrylated polyol and an alkylene glycol, a charge transport compound, a crosslinking agent, and which overcoating layer is formed in the presence of an acid catalyst; a photoconductor comprised of a photogenerating layer, and at least one charge transport layer, and wherein the photogenerating layer contains at least one silanol as illustrated herein; or wherein both the photogenerating layer and the at least one charge transport layer contains at least one silanol as illustrated herein, or wherein the charge transport layers have an absence of a silanol, and such a silanol is included in the photogenerating layer and in contact with the charge transport layer a top protective crosslinked overcoating layer as illustrated herein; an imaging member comprising a supporting substrate, a photogenerating layer thereover, and at least one charge transport layer comprised of at least one charge transport component, at least one silanol of the formula illustrated herein wherein R and R' are independently alkyl, alkoxy, or aryl, or mixtures thereof like phenyl, methyl, vinyl, allyl, isobutyl, isooctyl, cyclopentyl, cyclohexyl, cyclohexenyl-3-ethyl, epoxycyclohexyl-4-ethyl, fluorinated alkyl such as $CF_3CH_2CH_2$— and $CF3(CF_2)_5CH_2CH_2$—, methacrylolpropyl, or norbornenylethyl; a photoconductive member comprised of a substrate, a photogenerating layer thereover, at least one to about three charge transport layers thereover, a hole blocking layer, an adhesive layer wherein in embodiments the adhesive layer is situated between the photogenerating layer and the hole blocking layer, and wherein at least one of the charge transport layers and the photogenerating layer contain a silanol, or wherein the silanol is contained solely in the photogenerating layer with the photogenerating layer including a photogenerating component, such as a photogenerating pigment and a resin binder, and the at least one charge transport layer including at least one charge transport component, such as a hole transport component, a resin binder, and known additives like antioxidants, and in contact with the entire surface of the charge transport layer a top overcoating protective layer as illustrated herein.

The photoconductors illustrated herein can include in the photogenerating layer or the charge transport layer a dialkyldithiophosphate such as those represented by the following formulas/structures

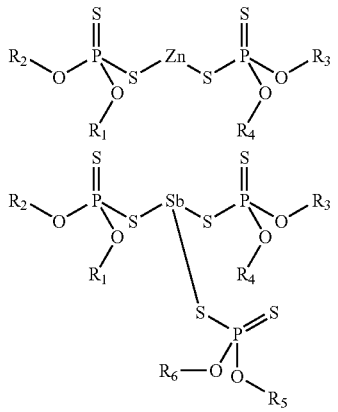

wherein $R_1$, $R_2$, $R_3$, $R_4$, $R_5$ and $R_6$ each independently represents a hydrogen atom, a suitable hydrocarbon like alkyl, cycloalkyl, aryl, alkylaryl or arylalkyl, and mixtures thereof.

In embodiments thereof there is disclosed a photoconductive imaging member comprised of a supporting substrate, a photogenerating layer thereover, a charge transport layer, and an overcoating polymer layer; a photoconductive member with a photogenerating layer of a thickness of from about 1 to about 10 microns, at least one transport layer each of a thickness of from about 5 to about 100 microns; a xerographic imaging apparatus containing a charging component, a development component, a transfer component, and a fixing component, and wherein the apparatus contains a photoconductive imaging member comprised of a supporting substrate, and thereover a layer comprised of a photogenerating pigment and a charge transport layer or layers, and thereover an overcoating layer, and where the transport layer is of a thickness of from about 40 to about 75 microns; a member wherein the silanol or dialkyldithiophosphate is present in an amount of from about 0.1 to about 40 weight percent, or from about 6 to about 20 weight percent; a member wherein the photogenerating layer contains a photogenerating pigment present in an amount of from about 10 to about 95 weight percent; a member wherein the thickness of the photogenerating layer is from about 1 to about 4 microns; a member wherein the photogenerating layer contains an inactive polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of known suitable polymers like polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers, especially a first and second layer, or a single charge transport layer and the charge transport compound in the overcoating layer comprises

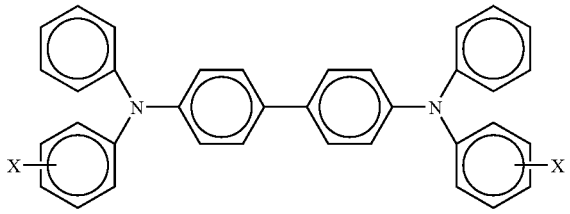

wherein X is selected from the group consisting of alkyl, alkoxy, and halogen, such as methyl and chloride; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein each or at least one of the charge transport layers, especially a first and second charge transport layer, or a single charge transport layer, and the overcoating charge transport compound comprises

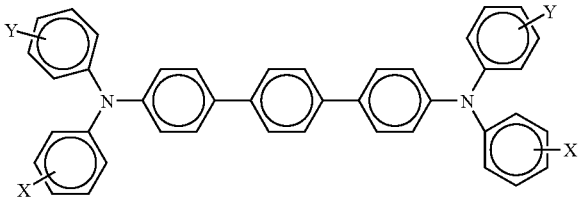

wherein X and Y are independently alkyl, alkoxy, aryl, a halogen, or mixtures thereof; an imaging member wherein, for example, alkyl and alkoxy contains from about 1 to about 15 carbon atoms; alkyl contains from about 1 to about 5 carbon atoms; and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing the ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging wherein the imaging member is exposed to light of a wavelength of from about 400 to about 950 nanometers; a member wherein the photogenerating layer is situated between the substrate and the charge transport; a member wherein the charge transport layer is situated between the substrate and the photogenerating layer, and wherein the number of charge transport layers is two; a member wherein the photogenerating layer is of a thickness of from about 5 to about 25 microns; a member wherein the photogenerating component amount is from about 0.05 weight percent to about 20 weight percent, and wherein the photogenerating pigment is dispersed in from about 10 weight percent to about 80 weight percent of a polymer binder; a member wherein the thickness of the photogenerating layer is from about 1 to about 11 microns; a member wherein the photogenerating and charge transport layer components are contained in a polymer binder; a member wherein the binder is present in an amount of from about 50 to about 90 percent by weight, and wherein the total of the layer components is about 100 percent; wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating component is Type V hydroxygallium phthalocyanine, or chlorogallium phthalocyanine, and the charge transport layer and/or overcoating contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methyl phenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; an imaging member further containing an adhesive layer and a hole blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer, and a top overcoating layer in contact with the hole transport layer, or in embodiments in contact with the photogenerating layer, and in embodiments wherein a plurality of charge transport layers are selected, such as, for example, from 2 to about 10, and more specifically 2 may be selected; and a photoconductive imaging member comprised of an optional supporting substrate, a photogenerating layer, and a first, second, and third charge transport layer.

Examples of POSS silanols wherein "throughout POSS" refers to polyhedral oligomeric silsesquioxane silanols include isobutyl-POSS cyclohexenyldimethylsilyldisilanol or isobutyl-polyhedral oligomeric silsesquioxane cyclohexenyidimethylsilyldisilanol ($C_{38}H_{84}O_{12}Si_8$), cyclopentyl-POSS dimethylphenyidisilanol ($C_{43}H_{76}O_{12}Si_8$), cyclohexyl-POSS dimethylvinyldisilanol ($C_{46}H_{88}O_{12}Si_8$), cyclopentyl-POSS dimethylvinyldisilanol ($C_{39}H_{74}O_{12}Si_8$), isobutyl-POSS dimethylvinyldisilanol ($C_{32}H_{74}O_{12}Si_8$), cyclopentyl-POSS disilanol ($C_{40}H_{74}O_{13}Si_8$), isobutyl-POSS disilanol ($C_{32}H_{74}O_{13}Si_8$), isobutyl-POSS epoxycyclohexyldisilanol ($C_{38}H_{84}O_{13}Si_8$), cyclopentyl-POSS fluoro(3)disilanol ($C_{40}H_{75}F_3O_{12}Si_8$), cyclopentyl-POSS fluoro(13)disilanol ($C_{45}H_{75}F_{13}O_{12}Si_8$), isobutyl-POSS fluoro(13)disilanol ($C_{38}H_{75}F_{13}O_{12}Si_8$), cyclohexyl-POSS methacryidisilanol ($C_{51}H_{96}O_{14}Si_8$), cyclopentyl-POSS methacryldisilanol ($C_{44}H_{82}O_{14}Si_8$), isobutyl-POSS methacryldisilanol ($C_{37}H_{82}O_{14}Si_8$), cyclohexyl-POSS monosilanol ($C_{42}H_{78}O_{13}Si_8$), cyclopentyl-POSS monosilanol (Schwabinol, $C_{35}H_{64}O_{13}Si_8$), isobutyl-POSS monosilanol ($C_{28}H_{64}O_{13}Si_8$), cyclohexyl-POSS norbornenylethyldisilanol ($C_{53}H_{98}O_{12}Si_8$), cyclopentyl-POSS norbornenylethyidisilanol ($C_{46}H_{84}O_{12}Si_8$), isobutyl-POSS norbornenylethyldisilanol ($C_{39}H_{84}O_{12}Si_8$), cyclohexyl-POSS TMS disilanol ($C_{45}H_{88}O_{12}Si_8$), isobutyl-POSS TMS disilanol ($C_{31}H_{74}O_{12}Si_8$), cyclohexyl-POSS trisilanol ($C_{42}H_{80}O_{12}Si_7$), cyclopentyl-POSS trisilanol ($C_{35}H_{66}O_{12}Si_7$), isobutyl-POSS trisilanol ($C_{28}H_{66}O_{12}Si_7$), isooctyl-POSS trisilanol ($C_{56}H_{122}O_{12}Si_7$), phenyl-POSS trisilanol ($C_{42}H_{38}O_{12}Si_7$), and the like, all commercially available from Hybrid Plastics, Fountain Valley, Calif. In embodiments, the POSS silanol is a phenyl-POSS trisilanol, or phenyl-polyhedral oligomeric silsesquioxane trisilanol of the following formula/structure

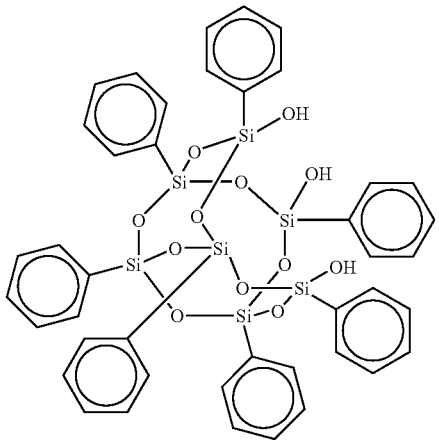

The POSS silanol can contain from about 7 to about 20 silicon atoms, or from about 7 to about 12 silicon atoms. The $M_w$ of the POSS silanol is, for example, from about 700 to about 2,000, or from about 800 to about 1,300.

Disclosed as silanol examples are

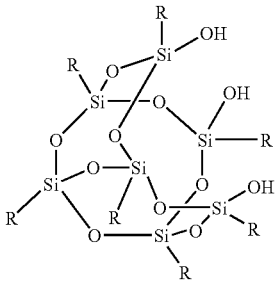

where R is phenyl;

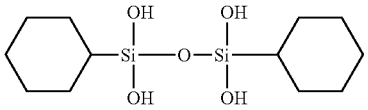

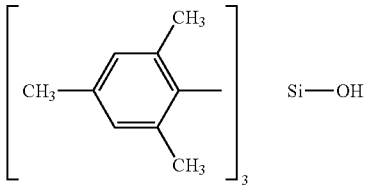

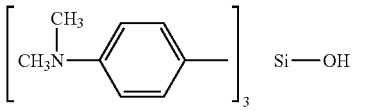

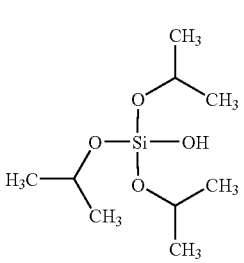

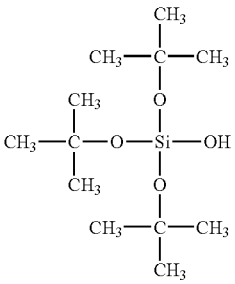

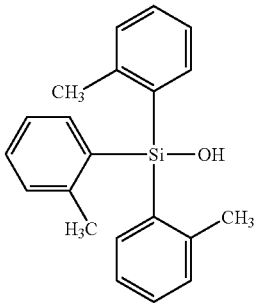

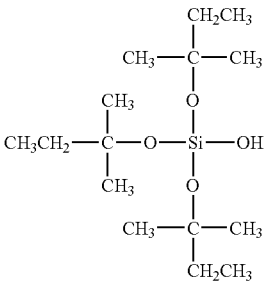

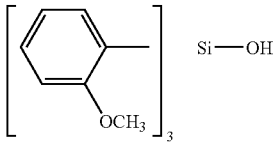

-continued

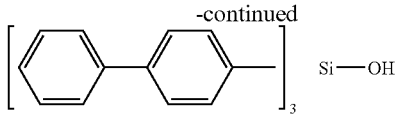

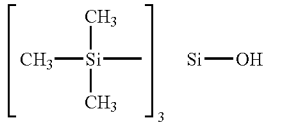

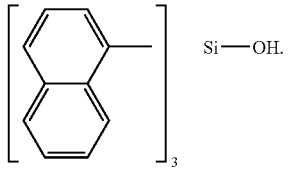

In embodiments, silanols that can be selected are free of POSS. Examples of such silanols include dimethyl(thien-2-yl)silanol, tris(isopropoxy)silanol, tris(tert-butoxy)silanol, tris(tert-pentoxy)silanol, tris(o-tolyl)silanol, tris(1-naphthyl)silanol, tris(2,4,6-trimethylphenyl)silanol, tris(2-methoxyphenyl)silanol, tris(4-(dimethylamino)phenyl)silanol, tris(4-biphenylyl)silanol, tris(trimethylsilyl)silanol, dicyclohexyltetrasilanol ($C_{12}H_{26}O_5Si_2$), mixtures thereof, and the like.

The silanols selected for the members, devices, and photoconductors illustrated herein are stable primarily in view of the Si—OH substituents in that these substituents eliminate water to form siloxanes, that is Si—O—Si linkages. While not being limited by theory, it is believed that the silanol hindered structures at the other three bonds attached to the silicon render them stable for extended time periods, such as from at least one week to over two years. The silanols can be included in the charge transport layer solution or dispersion, or the photogenerating layer solution or dispersion that is, for example, dissolved therein, or alternatively the silanols can be added to the charge transport and/or the photogenerating layer.

Various suitable amounts of the silanols can be selected, such as from about 0.01 to about 50 percent by weight of solids throughout, or from about 1 to about 30 percent by weight, or from about 5 to about 20 percent by weight. The silanols can be dissolved in the charge transport layer solution and the photogenerating solution, or alternatively the silanol can simply be added to the formed charge transport layer and/or the formed photogenerating layer. In embodiments, the silanol is included in the known dispersion milling process when preparing the photogenerating layer.

For the photogenerating layer, although not desiring to be limited by theory, it is believed that the photogenerating pigment is modified with a hydrophobic moiety by the in situ attachment of a hydrophobic silanol onto the photogenerating pigment surface with the remainder of the silanol interacting with the resin binder thereby enabling the pigment to be readily dispersible during the dispersion milling process.

The thickness of the photoconductor substrate layer depends on many factors, including economical considerations, electrical characteristics, and the like, thus this layer may be of substantial thickness, for example over 3,000 microns, such as from about 1,000 to about 2,000 microns, from about 500 to about 900 microns, from about 300 to about 700 microns, or of a minimum thickness. In embodiments, the thickness of this layer is from about 75 microns to about 300 microns, or from about 100 microns to about 150 microns.

The substrate may be opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, as disclosed in a copending application referenced herein, this layer may be of substantial thickness of, for example, up to many centimeters or of a minimum thickness of less than a millimeter. Similarly, a flexible belt may be of substantial thickness of, for example, about 250 micrometers, or of minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example, polycarbonate materials commercially available as MAKROLON®.

The photogenerating layer in embodiments is comprised of a number of known photogenerating pigments, such as for example, about 50 weight percent of Type V hydroxygallium phthalocyanine or chlorogallium phthalocyanine, and about 50 weight percent of a resin binder like poly(vinyl chloride-co-vinyl acetate) copolymer, such as VMCH (available from Dow Chemical). Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis (benzimidazo)perylene, titanyl phthalocyanines, and the like, and more specifically, vanadyl phthalocyanines, Type V hydroxygallium phthalocyanines, and inorganic components, such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin is present in various suitable amounts, for example from about 1 to about 50 weight percent, and more specifically, from about 1 to about 10 weight percent, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, silanols, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like; hydrogenated amorphous silicon; and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder, and fabricated by solvent coating techniques.

Infrared sensitivity can be desired for photoreceptors exposed to low cost semiconductor laser diode light exposure devices where, for example, the absorption spectrum and photosensitivity of the phthalocyanines selected depend on the central metal atom thereof. Examples include oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal free phthalocyanine. The phthalocyanines exist in many crystal forms, and have a strong influence on photogeneration.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The photogenerating composition or pigment is present in the resinous binder composition in various amounts. Generally, however, from about 5 percent by weight to about 90 percent by weight of the photogenerating pigment is dispersed in about 10 percent by weight to about 95 percent by weight of the resinous binder, or from about 20 percent by weight to about 50 percent by weight of the photogenerating pigment is dispersed in about 80 percent by weight to about 50 percent by weight of the resinous binder composition. In one embodiment, about 50 percent by weight of the photogenerating pigment is dispersed in about 50 percent by weight of the resinous binder composition.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer, and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 micron to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layers for the imaging members of the present disclosure can contain a number of components including known hole blocking components, such as amino silanes, doped metal oxides, TiSi, a metal oxide like titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene) bisphenol), P (4,4'-(1,4-phenylene diisopropylidene) bisphenol), S (4,4'-sulfonyidiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S; and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical); formaldehyde polymers with ammonia, cresol and phenol, such as VARCUM® 29112 (available from OxyChem Company); formaldehyde polymers with 4,4'-(1-methylethylidene) bisphenol, such as VARCUM® 29108 and 29116 (available from OxyChem Company); formaldehyde polymers with cresol and phenol, such as VARCUM® 29457 (available from OxyChem Company), DURITE® SD-423A, SD-422A (available from Borden Chemical); or formaldehyde polymers with phenol and p-tert-butylphenol, such as DURITE® ESD 556C (available from Borden Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

The charge transport layer, which layer is generally of a thickness of from about 5 microns to about 75 microns, and more specifically, of a thickness of from about 10 microns to about 40 microns, components, and molecules include a number of known materials, such as aryl amines, of the following formula

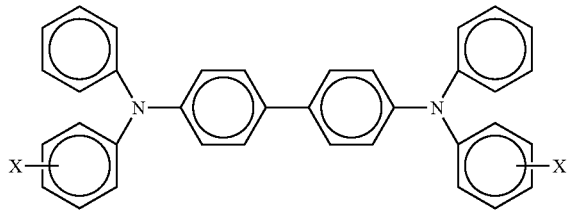

wherein X is alkyl, alkoxy, aryl, a halogen, or mixtures thereof, or wherein each X is present on each of the four terminating rings; and especially those substituents selected from the group consisting of Cl and $CH_3$; and molecules of the following formula

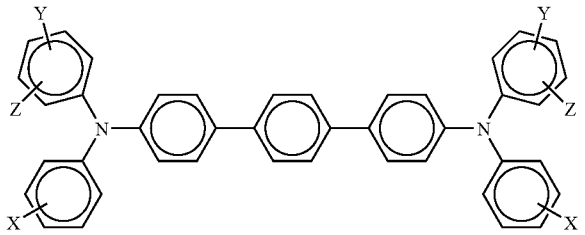

wherein at least one of X, Y and Z are independently alkyl, alkoxy, aryl, a halogen, or mixtures thereof, and wherein either Y, Z, or both Y and Z can be present; N,N'-diphenyl-N,N'-bis(3-hydroxyphenyl)-[1,1'-biphenyl]-4,4'-diamine represented by

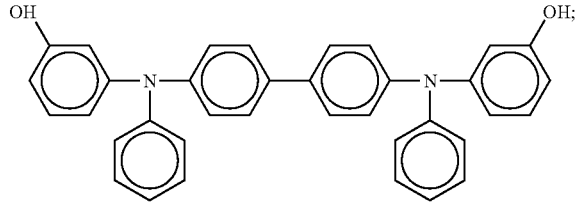

terphenyl arylamines as represented by

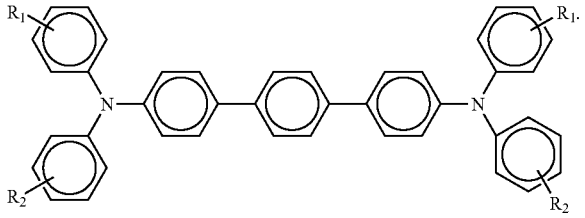

where each $R_1$ and $R_2$ is independently selected from the group consisting of at least one of —H, —OH, —$C_nH_{2n+1}$ where n is from 1 to about 12, aralkyl, and aryl groups, the aralkyl and aryl groups having, for example, from about 6 to about 36 carbon atoms. The dihydroxy arylamine compounds can be free of any direct conjugation between the —OH groups and the nearest nitrogen atom through one or more aromatic rings. The expression "direct conjugation" refers, for example, to the presence of a segment, having the formula —$(C{=}C)_n$—C=C— in one or more aromatic rings directly between an —OH group and the nearest nitrogen atom. Examples of direct conjugation between the —OH groups and the nearest nitrogen atom through one or more aromatic rings include a compound containing a phenylene group having an —OH group in the ortho or para position (or 2 or 4 position) on the phenylene group relative to a nitrogen atom attached to the phenylene group or a compound containing a polyphenylene group having an —OH group in the ortho or para position on the terminal phenylene group relative to a nitrogen atom attached to an associated phenylene group. Examples of aralkyl groups include, for example, —$C_nH_{2n}$-phenyl groups where n is from about 1 to about 5, or from about 1 to about 10; examples of aryl groups include, for example, phenyl, naphthyl, biphenyl, and the like. In embodiments when $R_1$ is —OH and each $R_2$ is n-butyl, the resultant compound is N,N'-bis[4-n-butylphenyl]-N,N'-di[3-hydroxyphenyl]-terphenyl-diamine. Also, in embodiments, the hole transport is soluble in the solvent selected for the formation of the overcoat layer.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

The charge transport layer component can be selected as the charge transport compound for the photoconductor top overcoating layer.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport layer may comprise charge transporting small molecules dissolved or molecularly dispersed in a film forming electrically inert polymer such as a polycarbonate. In embodiments, "dissolved" refers, for example, to forming a solution in which the small molecule and silanol are dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of charge transporting molecules present in the charge transport layer in an amount of, for example, from about 20 to about 55 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triaminotriphenyl methane. A small molecule charge transporting compound that permits injection of holes into the photogenerating layer with high efficiency, and transports them across the charge transport layer with short transit times, and which layer contains a binder and a silanol includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 5 to about 75 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and this thickness can be up to about 10 micrometers. In embodiments, this thickness for each layer is from about 1 micrometer to about 5 micrometers. Various suitable and conventional methods may be used to mix, and thereafter apply the overcoat layer coating mixture to the charge transport layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration.

The top charge transport layer can comprise the same components as the charge transport layer wherein the weight ratio between the charge transporting small molecules, and the suitable electrically inactive resin binder is less, such as for example, from about 0/100 to about 60/40, or from about 20/80 to about 40/60.

The photoconductors disclosed herein include a protective overcoating layer (POC) usually in contact with and contiguous to the charge transport layer. This POC layer is comprised of components that include (i) an acrylated polyol, and (ii) an alkylene glycol polymer, such as polypropylene glycol where the proportion of the acrylated polyol to the polypropylene glycol is, for example, from about 0.1:0.9 to about 0.9:0.1, at least one transport compound, and at least one crosslinking agent. The overcoat composition can comprise as a first polymer an acrylated polyol with a hydroxyl number of from about 10 to about 20,000; a second polymer of an alkylene glycol with, for example, a weight average molecular weight of from about 100 to about 20,000, from about 400 to about 5,000, or from about 1,000 to about 2,000, a charge transport compound; an acid catalyst, and a crosslinking agent wherein the overcoating layer, which is crosslinked, contains polyols, such as an acrylated polyol and a glycol, a crosslinking agent residue and a catalyst residue, all reacted into a polymeric network. While the percentage of crosslinking can be difficult to determine and not be desired to be limited by theory, the overcoat layer is crosslinked to a suitable value, such as for example, from about 5 to about 50 percent, from about 5 to about 25 percent, from about 10 to about 20 percent, and in embodiments from about 40 to about 65 percent. Excellent photoconductor electrical response can also be achieved when the prepolymer hydroxyl groups, and the hydroxyl groups of the dihydroxy aryl amine (DHTBD) are stoiciometrically less than the available methoxy alkyl on the crosslinking, such as CYMEL® moieties.

The photoreceptor overcoat can be applied by a number of different processes inclusive of dispersing the overcoat composition in a solvent system, and applying the resulting overcoat coating solution onto the receiving surface, for example, the top charge transport layer of the photoreceptor to a thickness of, for example, from about 0.5 micron to about 10, or from 0.5 to about 8 microns.

According to various embodiments, the crosslinkable polymer present in the overcoat layer can comprise a mixture of a polyol and an acrylated polyol film forming resins, and where, for example, the crosslinkable polymer can be electrically insulating, semiconductive or conductive, and can be charge transporting or free of charge transporting characteristics. Examples of polyols include a highly branched polyol where highly branched refers, for example, to a prepolymer synthesized using a sufficient amount of trifunctional alcohols, such as triols or a polyfunctional polyol with a high hydroxyl number to form a polymer comprising a number of branches off of the main polymer chain. The polyol can possess a hydroxyl number of, for example, from about 10 to about 10,000 and can include ether groups, or can be free of ether groups. Suitable acrylated polyols can be, for example, generated from the reaction products of propylene oxide modified with ethylene oxide, glycols, triglycerol and the like, and wherein the acrylated polyols can be represented by the following formula (2)

$$[R_t—CH_2]_t—[—CH_2—R_a—CH_2]_p—[—CO—R_b—CO—]_n—[—CH_2—R_c—CH_2]_p—[—CO—R_d—CO—]_q \quad (2)$$

where $R_t$ represents $CH_2CR_1CO_2$—, $R_1$ is alkyl with, for example, from 1 to about 25 carbon atoms, and more specifically, from 1 to about 12 carbon atoms, such as methyl, ethyl, propyl, butyl, hexyl, heptyl, and the like; $R_a$ and $R_c$ independently represent linear alkyl groups, alkoxy groups, branched alkyl or branched alkoxy groups with alkyl and alkoxy groups possessing, for example, from 1 to about 20 carbon atoms; $R_b$ and $R_d$ independently represent alkyl or alkoxy groups having, for example, from 1 to about 20 carbon atoms; and m, n, p, and q represent mole fractions of from 0 to 1, such that n+m+p+q=1. Examples of commercial acrylated polyols are JONCRYL™ polymers, available from Johnson Polymers Inc. and POLYCHEM™ polymers, available from OPC polymers.

The overcoat layer includes in embodiments a crosslinking agent and catalyst where the crosslinking agent can be, for example, a melamine crosslinking agent or accelerator. Incorporation of a crosslinking agent can provide reaction sites to interact with the acrylated polyol to provide a branched, crosslinked structure. When so incorporated, any suitable crosslinking agent or accelerator can be used, including, for example, trioxane, melamine compounds, and mixtures thereof. When melamine compounds are selected, they can be functionalized, examples of which are melamine formaldehyde, methoxymethylated melamine compounds, such as glycouril-formaldehyde and benzoguanamine-formaldehyde, and the like. In some embodiments, the crosslinking agent can include a methylated, butylated melamine-formaldehyde. A nonlimiting example of a suitable methoxymethylated melamine compound can be CYMEL® 303 (available from Cytec Industries), which is a methoxymethylated melamine compound with the formula $(CH_3OCH_2)_6N_3C_3N_3$ and the following structure

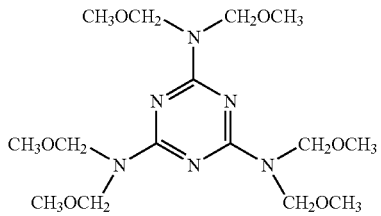

Crosslinking can be accomplished by heating the overcoating components in the presence of a catalyst. Non-limiting examples of catalysts include oxalic acid, maleic acid, carbolic acid, ascorbic acid, malonic acid, succinic acid, tartaric acid, citric acid, p-toluenesulfonic acid, methanesulfonic acid, and the like, and mixtures thereof.

A blocking agent can also be included in the overcoat layer, which agent can "tie up" or substantially block the acid catalyst effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine and commercial acid solutions containing blocking agents such as CYCAT® 4045, available from Cytec Industries Inc.

The temperature used for crosslinking varies with the specific catalyst, the catalyst amount, heating time utilized, and the degree of crosslinking desired. Generally, the degree of crosslinking selected depends upon the desired flexibility of the final photoreceptor. For example, complete crosslinking, that is 100 percent, may be used for rigid drum or plate photoreceptors. However, partial crosslinking, for example from about 20 percent to about 80 percent, is usually selected for flexible photoreceptors having, for example, web or belt configurations. The amount of catalyst to achieve a desired degree of crosslinking will vary depending upon the specific coating solution materials, such as polyol/acrylated polyol, catalyst, temperature, and time used for the reaction. Specifically, the polyester polyol/acrylated polyol is crosslinked at a temperature between about 100° C. and about 150° C. A typical crosslinking temperature used for polyols/acrylated polyols with p-toluenesulfonic acid as a catalyst is less than about 140° C., for example 135° C. for about 1 minute to about 40 minutes. A typical concentration of acid catalyst is from about 0.01 to about 5 weight percent based on the weight of polyol/acrylated polyol. After crosslinking, the overcoating should be substantially insoluble in the solvent in which it was soluble prior to crosslinking, thus permitting no overcoating material to be removed when rubbed with a cloth soaked in the solvent. Crosslinking results in the development of a three dimensional network which restrains the transport molecule in the crosslinked polymer network.

The overcoat layer can also include a charge transport material to, for example, improve the charge transport mobility of the overcoat layer. According to various embodiments, the charge transport material can be selected from the group consisting of at least one of (i) a phenolic substituted aromatic amine, (ii) a primary alcohol substituted aromatic amine, and (iii) mixtures thereof. In embodiments, the charge transport material can be a terphenyl of, for example, an alcohol soluble dihydroxy terphenyl diamine; an alcohol-soluble dihydroxy TPD, and the like. An example of a terphenyl charge transporting molecule can be represented by the following formula

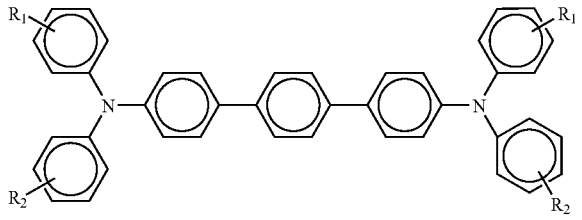

where each $R_1$ is —OH; and $R_2$ is alkyl (—$C_nH_{2n+1}$) where, for example, n is from 1 to about 10, from 1 to about 5, or from about 1 to about 6; and aralkyl and aryl groups with, for example, from about 6 to about 30, or about 6 to about 20 carbon atoms. Suitable examples of aralkyl groups include, for example, —$C_nH_{2n}$-phenyl groups where n is, for example, from about 1 to about 5 or from about 1 to about 10. Suitable examples of aryl groups include, for example, phenyl, naphthyl, biphenyl, and the like. In one embodiment, each $R_1$ is —OH to provide a dihydroxy terphenyl diamine hole transporting molecule. For example, where each $R_1$ is —OH and each $R_2$ is —H, the resultant compound is N,N'-diphenyl-N,N'-di[3-hydroxyphenyl]-terphenyl-diamine. In another embodiment, each $R_1$ is —OH, and each $R_2$ is independently an alkyl, aralkyl, or aryl group as defined above. In various embodiments, the charge transport material is soluble in the selected solvent used in forming the overcoat layer.

Any suitable secondary or tertiary alcohol solvent can be employed for the deposition of the film forming overcoat layer. Typical alcohol solvents include, but are not limited to, for example, tert-butanol, sec-butanol, 2-propanol, 1-methoxy-2-propanol, and the like, and mixtures thereof. Other suitable co-solvents that can be selected for the forming of the overcoat layer such as, for example, tetrahydrofuran, monochlorobenzene, and mixtures thereof. These co-solvents can be used as diluents for the above alcohol solvents, or they can be omitted. However, in some embodiments, it may be of value to minimize or avoid the use of higher boiling alcohol solvents since they should be removed as they may interfere with efficient crosslinking.

In embodiments, the components, including the crosslinkable polymer, charge transport material, crosslinking agent, acid catalyst, and blocking agent, utilized for the overcoat solution should be soluble or substantially soluble in the solvents or solvents employed for the overcoating.

The thickness of the overcoat layer, which can depend upon the abrasiveness of the charging (for example bias charging roll), cleaning (for example blade or web), development (for example brush), transfer (for example bias transfer roll), etc., in the system employed, is for example, from about 1 or about 2 microns up to about 10 or about 15 microns, or more. In various embodiments, the thickness of the overcoat layer can be from about 1 micrometer to about 5 micrometers. Typical application techniques for applying the overcoat layer over the photoconductive layer can include spraying, dip coating, roll coating, wire wound rod coating, and the like. Drying of the deposited overcoat layer can be effected by any suitable conventional technique such as oven drying, infrared radiation drying, air drying, and the like. The dried overcoat layer of this disclosure should transport charges during imaging.

In the dried overcoat layer, the composition can include from about 40 to about 90 percent by weight of film forming crosslinkable polymer, and from about 60 to about 10 percent by weight of charge transport material. For example, in embodiments, the charge transport material can be incorporated into the overcoat layer in an amount of from about 20 to about 50 percent by weight. As desired, the overcoat layer can also include other materials, such as conductive fillers, abrasion resistant fillers, and the like, in any suitable and known amounts.

Although not desired to be limited by theory, the crosslinking agent can be located in the central region with the polymers like the acrylated polyol, polyalkylene glycol, and also charge transport component being associated with the crosslinking agent, and extending in embodiments from the central region. Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

At least one charge transport layer refers, for example, to a single layer or a plurality of layers, such as from 1 to about 10 layers or more in certain situations, and more specifically, from 1 to about 4 layers, and yet more specifically 2 layers, and where one of the charge transport layers contains a thiophosphate, two charge transport layers contain a thiophosphate, 3, 4, or 5 charge transport layers contain a thiophosphate and in embodiments where a first charge transport layer in contact with the photogenerating layer contains a thiophosphate and a second charge transport layer in contact with the first charge transport layer and in contact with the overcoating layer is free of a thiophosphate.

Primarily for purposes of brevity, the examples of each of the substituents, and each of the components/compounds/molecules, polymers (components) for each of the layers specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. Similarly, the thickness of each of the layers, the examples of components in each of the layers, the amount ranges of each of the components disclosed and claimed are not exhaustive, and it is intended that the present disclosure and claims encompass other suitable parameters not disclosed or that may be envisioned.

The following Examples are provided.

Example I

An imaging member or photoconductor was prepared by providing a 0.02 micrometer thick titanium layer coated (the coater device) on a biaxially oriented polyethylene naphthalate substrate (KALEDEX™ 2000) having a thickness of 3.5 mils, and applying thereon, with a gravure applicator, a solution containing 50 grams of 3-amino-propyltriethoxysilane (blocking or undercoat layer), 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating thereof over the blocking layer, using a gravure applicator, and which adhesive contained 0.2 percent by weight based on the total weight of the solution of copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the above forced air dryer of the coater. The resulting adhesive layer had a dry thickness of 200 Angstroms.

A photogenerating layer dispersion was prepared by introducing 0.45 grams of the known polycarbonate LUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The charge generation layer was dried at 135° C. for 5 minutes in a forced air oven to form a dry photogenerating layer having a thickness of 0.4 micrometer.

The resulting imaging member web was then overcoated with a two-layer charge transport layer. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON® 5705, a known polycarbonate resin having a molecular weight average of from about 50,000 to 100,000, commercially available from Farbenfabriken Bayer A.G. The resulting mixture was then dissolved in methylene chloride to form a solution containing 15 percent by weight solids. This solution was applied, using a 2 mil Bird bar, onto the photogenerating layer to form the bottom layer coating that upon drying (120° C. for 1 minute) had a thickness of 14.5 microns. During this coating process, the humidity was equal to or less than 15 percent.

The bottom layer of the charge transport layer (CTL) was then overcoated with a top charge transport layer in a second pass. The charge transport layer solution of the top layer was prepared as described above for the bottom layer. This solution was applied, using a 2 mil Bird bar, on the bottom layer of the charge transport layer to form a coating that upon drying (120° C. for 1 minute) had a thickness of 14.5 microns. During this coating process the humidity was equal to or less than 15 percent. The total CTL thickness was 29 microns.

Example II

An imaging member or photoconductor was prepared by repeating the process of Example I except that the bottom layer of the charge transport layer was prepared by introducing into an amber glass bottle in a weight ratio of 47.5:47.5:5 N,N'-diphenyl-N,N'-bis(3-methylphenyl)-1,1'-biphenyl-4,4'-diamine, MAKROLON® 5705, a polycarbonate resin having a molecular weight of from about 50,000 to about 100,000, commercially available from Farbenfabriken Bayer A.G., and zinc dialkyldithiophosphate (ZDDP ELCO-103™, a mixture of two primary alcohols and one secondary alcohol, each with from 3 to 5 carbon atoms), commercially available from Elco Corporation of Cleveland, Ohio. The resulting mixture was dissolved in methylene chloride to form a solution containing 15 percent by weight solids. This solution was applied, using a 2 mil Bird bar, onto the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top charge transport layer in a second pass.

The solution of the top uppermost charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied, using a 2 mil Bird bar, on the bottom layer of the charge transport layer to form a coating that upon drying (120° C. for 1 minute) had a thickness of 14.5 microns. The total charge transport layers thickness was 29 microns.

Example III

An imaging member was prepared by repeating the process of Example I except that the bottom charge transport layer was prepared by introducing into an amber glass bottle in a weight ratio of 48.75:48.75:2.5 N,N'-diphenyl-N,N'-bis(3-methylphenyl)-1,1'-biphenyl-4,4'-diamine, MAKROLON® 5705, a polycarbonate resin having a molecular weight of from about 50,000 to about 100,000, commercially available from Farbenfabriken Bayer A.G., and zinc dialkyldithiophosphate (ZDDP ELCO-103™, a mixture of two primary alcohols and one secondary alcohol, each with from 3 to 5 carbon atoms; primary and secondary propyl, butyl and pentyl), commercially available from Elco Corporation of Cleveland, Ohio. The resulting mixture was dissolved in methylene chloride to form a solution containing 15 percent by weight solids. This solution was applied, using a 2 mil Bird bar, onto the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top charge transport layer in a second pass. The solution of the uppermost top charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied, using a 2 mil Bird bar, on the bottom layer of the charge transport layer to form a coating that upon drying (120° C. for 1 minute) had a thickness of 14.5 microns. The total CTL thickness was 29 microns.

Example IV

An imaging member was prepared by repeating the process of Example I except that the bottom layer of the charge transport layer was prepared by introducing into an amber glass bottle in a weight ratio of 42.5:42.5:15 N,N'-diphenyl-N,N'-bis(3-methylphenyl)-1,1'-biphenyl-4,4'-diamine, MAKROLON® 5705, a polycarbonate resin having a molecular weight (weight average) of from about 50,000 to about 100,000, commercially available from Farbenfabriken Bayer A.G., and the above thiophosphate ZDDP ELCO-103™, commercially available from Elco Corporation. The resulting mixture was dissolved in methylene chloride to form a solution containing 15 percent by weight solids. This solution was applied, using a 2 mil Bird bar, onto the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top charge transport layer in a second pass. The solution of the uppermost charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON 5705™, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied, using a 2 mil Bird bar, on the bottom layer of the charge transport layer to form a coating that upon drying (120° C. for 1 minute) had a thickness of 14.5 microns. The total CTL thickness was 29 microns.

Example V

An imaging member was prepared by repeating the process of Example I except that the top charge transport layer and the bottom charge transport layer were prepared by introducing into an amber glass bottle in a weight ratio of 46.25:46.25:7.5 N,N'-diphenyl-N,N'-bis(3-methylphenyl)-1,1'-biphenyl-4,4'-diamine, MAKROLON® 5705, a polycarbonate resin having a molecular weight of from about 50,000 to about 100,000, commercially available from Farbenfabriken Bayer A.G., and the above thiophosphate ZDDP ELCO-103™, commercially available from Elco Corporation. The resulting mixture was dissolved in methylene chloride to form a solution containing 15 percent by weight solids. This solution was applied, using a 2 mil Bird bar, onto the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top charge transport layer in a second pass. The solution of the uppermost charge transport layer was prepared as indicated above by introducing into an amber glass bottle in a weight ratio of 46.25:46.25:7.5 N,N'-diphenyl-N,N'-bis(3-methylphenyl)-1,1'-biphenyl-4,4'-diamine, MAKROLON® 5705, a polycarbonate resin having a molecular weight of from about 50,000 to about 100,000, commercially available from Farbenfabriken Bayer A.G., and the above thiophosphate ZDDP ELCO-103™, commercially available from Elco Corporation. The resulting mixture was then dissolved in methylene chloride to form a solution containing 15 percent by weight solids. This solution was applied, using a 2 mil Bird bar, on the bottom layer of the charge transport layer to form a coating that upon drying (120° C. for 1 minute) had a thickness of 14.5 microns. The total CTL thickness was 29 microns.

Example VI

Preparation of Overcoat Coating Solution:

An overcoat coating solution was formed by adding 10 grams of POLYCHEM® 7558-B-60 (an acrylated polyol obtained from OPC Polymers), 4 grams of PPG 2K (a polypropyleneglycol with a weight average molecular weight of 2,000 as obtained from Sigma-Aldrich), 6 grams of CYMEL® 1130 (a methylated, butylated melamine-formaldehyde crosslinking agent obtained from Cytec Industries Inc.), 8 grams of N,N'-diphenyl-N,N'-di[3-hydroxyphenyl]- terphenyl-diamine (DHTBD), 1.5 grams of SILCLEAN™ 3700 (a hydroxylated silicone available from BYK-Chemie USA), and 5.5 grams [1 percent by weight] of 8 percent p-toluenesulfonic acid catalyst in 60 grams of DOWANOL® PM (1-methoxy-2-propanol obtained from the Dow Chemical Company).

Example VII

The photoconductor of Example I was overcoated with the solution from Example VI using a ⅛ mil Bird bar. The resultant film was dried in a forced air oven for 2 minutes at 125° C. to yield a highly crosslinked, 3 micron thick overcoat, and which overcoat was substantially insoluble in methanol or ethanol.

Example VIII

The photoconductor of Example II was overcoated with the solution of Example VI using a ⅛ mil Bird bar. The resultant film was dried in a forced air oven for 2 minutes at 125° C. to yield a highly crosslinked, 3 micron thick overcoat, and which overcoat was substantially insoluble in methanol or ethanol.

Example IX

The photoconductor of Example III was overcoated with the solution of Example VI using a ⅛ mil Bird bar. The resultant film was dried in a forced air oven for 2 minutes at 125° C. to yield a highly crosslinked, 3 micron thick overcoat.

Example X

The photoconductor of Example IV was overcoated with the solution of Example VI using a ⅛ mil Bird bar. The resultant film was dried in a forced air oven for 2 minutes at 125° C. to yield a highly crosslinked, 3 micron thick overcoat.

Electrical Property Testing:

The above prepared photoconductor devices were tested in a scanner set to obtain photoinduced discharge cycles, sequenced at one charge-erase cycle, followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of −500 volts with the exposure light intensity incrementally increased by means of a data acquisition system where the current to the light emitting diode was controlled to obtain different exposure levels. The exposure light source was a 780 nanometer light emitting diode. The xerographic simulation process was completed in an environmentally controlled light tight chamber at ambient conditions (40 percent relative humidity and 22° C.). The devices were also operated for 10,000 imaging cycles electrically with charge-discharge-erase. Ten photoinduced discharge characteristic (PIDC) curves were generated at both cycle=0 and cycle=10,000. The results are summarized in Table 1.

TABLE 1

| | V (3.5 ergs/cm$^2$) (V) | |
|---|---|---|
| | Cycle = 0 | Cycle = 10,000 |
| EXAMPLE VII | 66 | 121 |
| EXAMPLE VIII | 56 | 76 |
| EXAMPLE IX | 58 | 81 |
| EXAMPLE X | 53 | 75 |
| EXAMPLE X | 53 | 77 |

In embodiments there are disclosed a number of improved characteristics for the disclosed thiophosphate photoconductive members as determined by the generation of known PIDC curves, such as minimization or prevention of $V_r$ cycle up by the physical doping amount of the dialkyldithiophosphate in the charge transport layer. More specifically, V (3.5 ergs/cm$^2$) in Table 1 represents the surface potential of the devices when exposure is 3.5 ergs/cm$^2$, and is used to characterize the PIDC. Incorporation of the thiophosphate into the charge transport layer reduces V (3.5 ergs/cm$^2$) and prevents its cycle up with long cycling as contrasted.

In embodiments, incorporation of the above thiophosphate into the charge transport layer together with the overcoat of Example VI reduces ghosting as compared to a photoconductor with no overcoating, and with no CTL thiophosphate.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An imaging member comprising an optional supporting substrate, a photogenerating layer, and at least one charge transport layer, and wherein at least one charge transport layer contains at least one charge transport component and at least one thiophosphate; and an overcoating layer in contact with and contiguous to said charge transport layer, and which overcoating is comprised of an acrylated polyol, a polyalkylene glycol, a crosslinking component, and a charge transport component.

2. An imaging member in accordance with claim 1 wherein said supporting substrate is present, said overcoating layer further contains a catalyst, and said alkylene glycol is a polypropylene glycol.

3. An imaging member in accordance with claim 1 wherein the acrylated polyol has a hydroxyl number of from about 10 to about 20,000 and wherein said acrylate polyol, said alkylene polyol, said crosslinking component, and said charge transport component are reacted in the presence of an acid catalyst to form a crosslinked polymeric network.

4. An imaging member in accordance with claim 1 wherein the acrylated polyol has a hydroxyl number of from about 500 to about 2,000.

5. An imaging member in accordance with claim 2 wherein said polypropylene glycol possesses a weight average molecular weight of from about 100 to about 20,000, and wherein said acrylate polyol, said propylene glycol, said crosslinking agent, and said charge transport component are reacted in the presence of said catalyst into a crosslinked polymeric network.

6. An imaging member in accordance with claim 2 wherein said polypropylene glycol possesses a weight average molecular weight of from about 400 to about 5,000.

7. An imaging member in accordance with claim 2 wherein the weight ratio of said acrylated polyol to said polypropylene glycol is from about 2:8 to about 8:2 wherein said acrylate polyol, said poly propylene glycol, said crosslinking agent, and said charge transport component are reacted in the presence of said catalyst resulting in a crosslinked polymeric network containing said acrylate polyol, said polypropylene glycol, said crosslinking agent, said catalyst, and said charge transport component.

8. An imaging member in accordance with claim 1 wherein the overcoating charge transport component is selected from the group consisting of at least one of (i) a phenolic substituted aromatic amine, and (ii) a primary alcohol substituted aromatic amine.

9. An imaging member in accordance with claim 1 wherein the overcoating charge transport component is

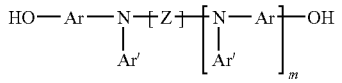

wherein m is zero or 1; Z is selected from the group consisting of at least one of

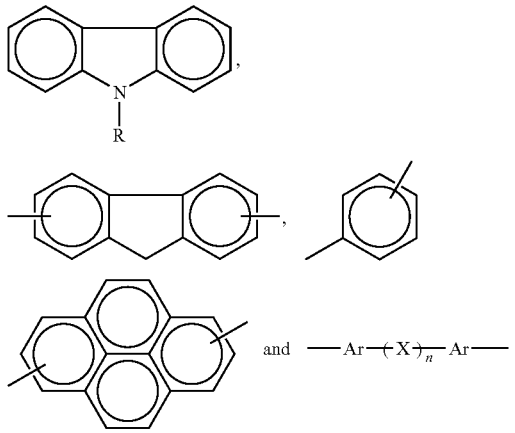

wherein n is 0 or 1; Ar is selected from the group consisting of at least one of

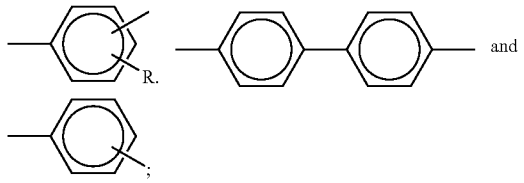

R is selected from the group consisting of at least one of —$CH_3$, —$C_2H_5$, —$C_3H_7$, and $C_4H_9$, and Ar' is selected from the group consisting of at least one of

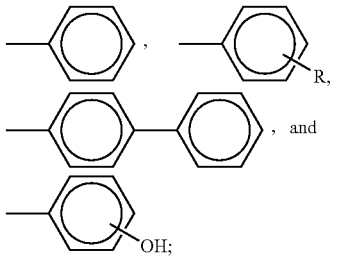

and X is selected from the group consisting of at least one of

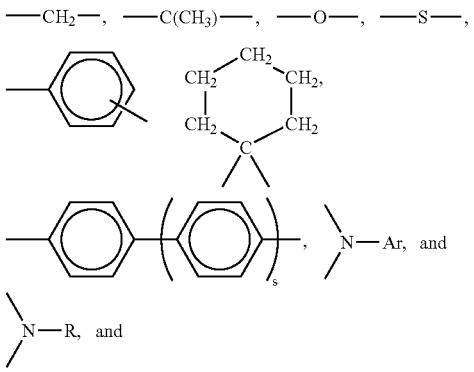

wherein S is zero, 1, or 2.

10. An imaging member in accordance with claim 1 wherein the crosslinking agent is a methylated butylated melamine formaldehyde.

11. An imaging member in accordance with claim 1 wherein said crosslinking agent is a methoxymethylated melamine compound of the formula $(CH_3OCH_2)_6N_3C_3N_3$.

12. An imaging member in accordance with claim 2 wherein said crosslinking agent is

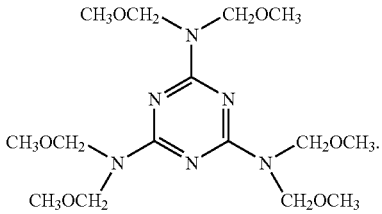

13. An imaging member in accordance with claim 1 wherein said at least one thiophosphate is comprised of a dialkyldithiophosphate.

14. An imaging member in accordance with claim 1 wherein said photogenerating layer is comprised of a photogenerating component, and a polymer binder.

15. An imaging member in accordance with claim 1 wherein said at least one thiophosphate is one, and which thiophosphate is present in a first and in a second charge transport layer.

16. An imaging member in accordance with claim 1 wherein said charge transport layer is comprised of aryl amine molecules, and which aryl amines are of the formula

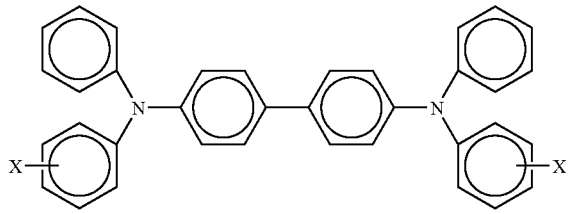

wherein X is selected from the group consisting of at least one of alkyl, alkoxy, aryl, and halogen.

17. An imaging member in accordance with claim 16 wherein alkyl and alkoxy each contain from about 1 to about 12 carbon atoms.

18. An imaging member in accordance with claim 16 wherein said aryl amine is N,N'-diphenyl-N,N-bis(3-methylphenyl)-1,1'-biphenyl-4,4'-diamine.

19. An imaging member in accordance with claim 1 wherein said charge transport layer is comprised of aryl amine molecules, and which aryl amines are of the formula

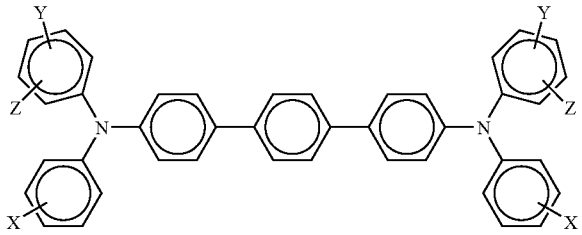

wherein each X, Y and Z is independently selected from the group consisting of at least one alkyl, alkoxy, aryl, and halogen, and mixtures thereof.

20. An imaging member in accordance with claim 19 wherein each alkoxy and alkyl contains from about 1 to about 10 carbon atoms; aryl contains from 6 to about 36 carbon atoms; and halogen is chloride, bromide, fluoride, or iodide.

21. An imaging member in accordance with claim 19 wherein said aryl amine is selected from the group consisting of at least one of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine.

22. An imaging member in accordance with claim 1 wherein said at least one charge transport layer contains an antioxidant comprised of a hindered phenol or a hindered amine.

23. An imaging member in accordance with claim 1 wherein said at least one charge transport layer is from 1 to about 7 layers.

24. An imaging member in accordance with claim 1 wherein said at least one charge transport layer is from 1 to about 3 layers.

25. An imaging member in accordance with claim 1 wherein said at least one charge transport layer is comprised of a top charge transport layer and a bottom charge transport layer, and wherein said bottom layer is situated between said photogenerating layer and said top charge transport layer, and wherein said thiophosphate is present in said bottom layer situated between said photogenerating layer and said top charge transport layer in contact with said overcoating.

26. An imaging member in accordance with claim 1 wherein said at least one thiophosphate is one and said thiophosphate is a zinc dialkyldithiophosphate.

27. An imaging member in accordance with claim 1 wherein said photogenerating layer is comprised of a photogenerating component, and a polymeric resin, and said at least one charge transport is comprised of two layers, and wherein said phosphate is present in one of said layers.

28. An imaging member in accordance with claim 1 wherein said photogenerating layer is comprised of at least one of a metal free phthalocyanine, titanyl phthalocyanine, a halogallium phthalocyanine, a perylene, or mixtures thereof.

29. An imaging member in accordance with claim 1 wherein said photogenerating layer is comprised of a chlorogallium phthalocyanine pigment or a hydroxygallium phthalocyanine pigment.

30. An imaging member in accordance with claim 1 wherein said thiophosphate is a metal free or metal containing thiophosphate, and wherein said metal is selected from the group consisting of zinc, molybdenum, lead, and antimony, and mixtures thereof.

31. An imaging member in accordance with claim 1 wherein said thiophosphate is

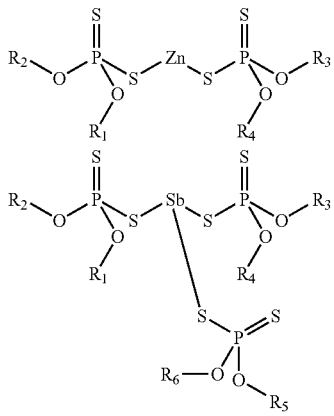

and wherein $R_1$, $R_2$, $R_3$, $R_4$, $R_5$ and $R_6$ each independently represents a hydrogen atom, alkyl, cycloalkyl, aryl, alkylaryl or arylalkyl or mixtures thereof.

32. An imaging member in accordance with claim 31 wherein $R_1$, $R_2$, $R_3$, $R_4$, $R_5$ and $R_6$ each independently represents alkyl containing from 1 to about 20 carbon atoms; cycloalkyl containing from 6 to about 26 carbon atoms; aryl, alkylaryl or arylalkyl containing from about 6 to about 50 carbon atoms; or optionally wherein $R_1$ to $R_6$ are a hydrocarbyl group containing an ester, ether, alcohol, or carboxyl group, and wherein said thiophosphate is present in at least one charge transport layer, which layer includes a first charge transport layer, and a second charge transport layer in contact with said overcoat layer.

33. An imaging member in accordance with claim 1 wherein said thiophosphate is a zinc dialkyldithiophosphate, and wherein said alkyl is a straight chain or branched alkyl with from about 2 to about 18 carbon atoms.

34. An imaging member in accordance with claim 1 wherein said thiophosphate is present in an amount of from about 0.01 to about 30 weight percent.

35. An imaging member in accordance with claim 1 wherein said thiophosphate is present in an amount of from about 0.1 to about 10 weight percent, or from about 0.5 to about 5 weight percent.

36. An imaging member in accordance with claim 1 wherein at least one charge transport layer is from about 2 to about 4 layers, and wherein at least one thiophosphate is from 1 to about 3 thiophosphates, and which thiophosphate is present in 1 or 2 charge transport layers.

37. The member in accordance with claim 1 wherein the overcoat layer comprises from about 0 to about 60 percent by weight of said charge transport component and from about 100 to about 60 percent by weight of said polyol, said polyalkylene glycol, and said crosslinking component, and optionally wherein the overcoat layer has a thickness from about 0.1 micron to about 8 microns.

38. A flexible photoconductor comprised in sequence of a substrate, a photogenerating layer, and at least one charge transport layer comprised of at least one charge transport component, and wherein at least one charge transport layer is comprised of hole transport molecules and a dialkyldithiophosphate

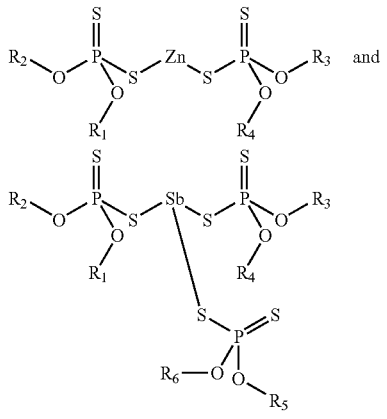

wherein $R_1$, $R_2$, $R_3$, $R_4$, $R_5$ and $R_6$ each independently represents at least one of a hydrogen atom, alkyl, and aryl; and an overcoating layer in contact with and contiguous to the top charge transport layer, and which overcoating layer is formed by the reaction of an acrylate polyol, a polyalkylene, a crosslinking agent, and a charge transport compound in the presence of a catalyst resulting in a polymeric network primarily containing said acrylate polyol, said crosslinking agent, said glycol, and said charge transport compound.

39. A photoconductor in accordance with claim 38 wherein said thiophosphate is molybdenum di(2-ethylhexyl)dithiophosphate, zinc diethyldithiophosphate, or antimony diamyldithiophosphate.

40. A photoconductor in accordance with claim 38 wherein said acrylated polyol is represented by $$(—CH_2—R_a—CH_2)_m—(—CO—R_b—CO—)_n—(—CH_2—R_c—CH_2)_p—(—CO—R_d—CO—)_q$$

where $R_a$ and $R_c$ independently represent at least one of a linear alkyl group, a linear alkoxy group, a branched alkyl group, and a branched alkoxy group, wherein each alkyl and alkoxy group contain from about 1 to about 20 carbon atoms; $R_b$ and $R_d$ independently represent at least one of an alkyl and alkoxy wherein said alkyl and said alkoxy each contain from about 1 to about 20 carbon atoms; and m, n, p, and q represent mole fractions of from 0 to 1, such that n+m+p+q=1.

41. A photoconductor comprising a supporting substrate, a photogenerating layer, and at least one charge transport layer comprised of at least one charge transport component, and wherein at least one charge transport layer is comprised of hole transport molecules and a thiophosphate represented by formulas/structures

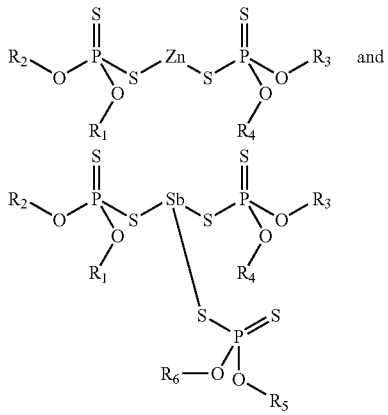

wherein $R_1$, $R_2$, $R_3$, $R_4$, $R_5$ and $R_6$ each independently represents a hydrogen atom; alkyl, alkoxy, or aryl, and wherein said at least one charge transport layer is comprised of from 2 to about 4 layers, and wherein 1 layer, 2 layers, 3 layers, or 4 charge transport layers contain said thiophosphate; and a layer in contact with and contiguous to said top charge transport layer, and which layer is comprised of a crosslinked polymeric network.

42. A photoconductor in accordance with claim 41 wherein said acrylated polyol is represented by $$(—CH_2—R_a—CH_2)_m—(—CO—R_b—CO—)_n—(—CH_2—R_c—CH_2)_p—(—CO—R_d—CO—)_q$$

where $R_a$ and $R_c$ independently represent at least one of a linear alkyl group, a linear alkoxy group, a branched alkyl group, and a branched alkoxy group, wherein each alkyl and alkoxy group contain from about 1 to about 20 carbon atoms; $R_b$ and $R_d$ independently represent at least one of an alkyl and alkoxy wherein said alkyl and said alkoxy each contain from about 1 to about 20 carbon atoms; and m, n, p, and q represent mole fractions of from 0 to 1, such that n+m+p+q=1; and wherein said polymeric network primarily contains said acrylate polyol, said glycol, said crosslinking agent, and said charge transport compound.

43. A photoconductor in accordance with claim 41 wherein said thiophosphate is molybdenum di(2-ethylhexyl)dithiophosphate, zinc diethyldithiophosphate, or antimony diamyldithiophosphate.

* * * * *